United States Patent [19]

Kiray

[11] 4,225,133

[45] Sep. 30, 1980

[54] DEVICE FOR TEACHING BATTING TECHNIQUES

[76] Inventor: Joseph D. Kiray, 116 Old Gate Rd., Trafford, Pa. 15085

[21] Appl. No.: 84,472

[22] Filed: Oct. 12, 1979

[51] Int. Cl.[3] ..... A63B 69/40

[52] U.S. Cl. ..... 273/26 R

[58] Field of Search ..... 273/187 R, 26 B, 26 R, 273/195 B, 186 R, 186 A, 183 B, 195 A, 183 A

[56] References Cited

U.S. PATENT DOCUMENTS

| | | | |
|---|---|---|---|
| 2,985,452 | 5/1961 | Trippet | 273/26 R |
| 3,169,022 | 2/1965 | Kretsinger | 273/26 R |
| 3,342,487 | 9/1967 | David | 273/26 R |
| 3,368,541 | 2/1968 | Brink | 273/26 R |
| 3,940,131 | 2/1976 | Claire, Jr. | 273/26 R |
| 3,979,116 | 9/1976 | Matchick | 273/26 R |
| 3,994,501 | 11/1976 | O'Donnell | 273/186 R |
| 4,034,991 | 7/1977 | Oppenheimer | 273/26 R |

*Primary Examiner*—Richard C. Pinkham
*Assistant Examiner*—T. Brown
*Attorney, Agent, or Firm*—Reed Smith Shaw & McClay

[57] ABSTRACT

A device for teaching baseball batting techniques in which a base (10) provides a well (12) for one of the batter's feet and an arm (14) provides a yieldable barrier that reminds the batter whenever he has stepped away from the pitcher's mound and into the arm. The arm (14) is pivoted such that it forms a yieldable barrier that does not trip the batter. The device also preferably includes a chord (20) that is adjusted to a length such that it checks the batter's swing at levels above his strike zone.

4 Claims, 4 Drawing Figures

DEVICE FOR TEACHING BATTING TECHNIQUES

BACKGROUND OF THE INVENTION

1. Field of the Invention

The present invention relates to devices to aid in instructing athletic techniques and, in particular, in instructing baseball batting techniques.

2. Description of the Prior Art

Accepted baseball batting technique includes a slight step or stride toward the pitcher as the ball is being swung at. A persistant problem in teaching baseball batting techniques is to teach one how to avoid an apparently natural tendency to stride toward the baselines and not directly toward the pitcher.

Many devices have been developed in the prior art for teaching various batting techniques to baseball players. For example, U.S. Pat. Nos. 3,595,583; 4,034,991; 3,940,131; and 2,985,452 are directed to perfecting various aspects of the batting swing. U.S. Pat. No. 3,436,076 purports to teach the batter to be able to maintain eye contact with the ball. U.S. Pat. No. 3,979,116 suggests a device for teaching the batter to take a stride of the proper length.

However, none of the devices in the prior art were useful in teaching the batter to stride directly toward the pitcher's mound. Accordingly, there was a need in the prior art for a teaching aid that would help accomplish this object.

SUMMARY OF THE INVENTION

In accordance with the present invention, a device to aid in teaching baseball batting techniques includes a base in which a well is formed. A guide arm is connected to the base such that it is pivoted between a position that is substantially normal to base and a position that is substantially parallel to the base.

Preferably, the arm is at least one inch high when in the first position such that, when the device is properly positioned in the batter's box, it provides a yieldable barrier to batters striding toward the base line and not toward the pitcher's mound.

Preferably, the device further includes a bat that is tied to the base by a chord attached to the handle end of the bat. The length of the chord is adjustable in accordance with the height of the batter such that the chord restricts free swing of the bat above the batter's strike zone.

Other details, objects and advantages of the invention will become apparent as the following description of a presently preferred embodiment thereof proceeds.

BRIEF DESCRIPTION OF THE DRAWINGS

The accompanying drawings show a presently preferred embodiment of the invention in which.

DESCRIPTION OF A PREFERRED EMBODIMENT

Figure 1:
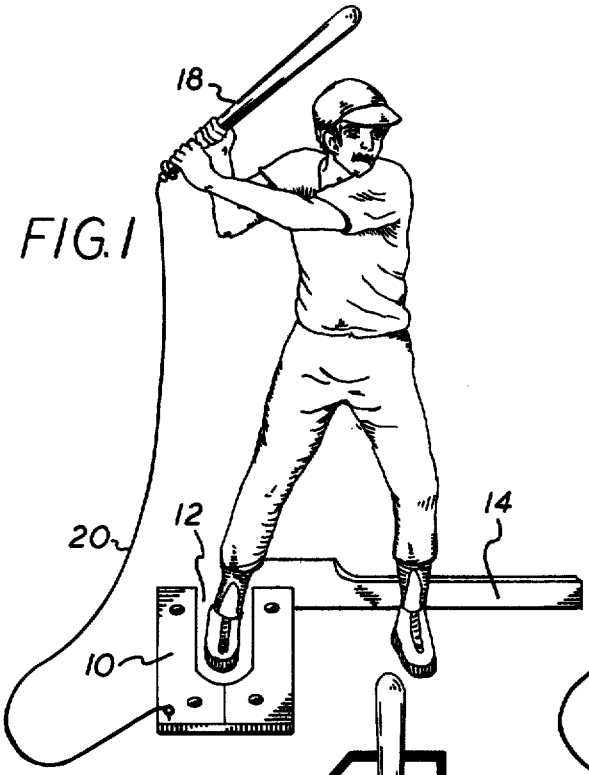
FIG. 1 illustrates a baseball batter in a normal batting stance.
Figure 2:
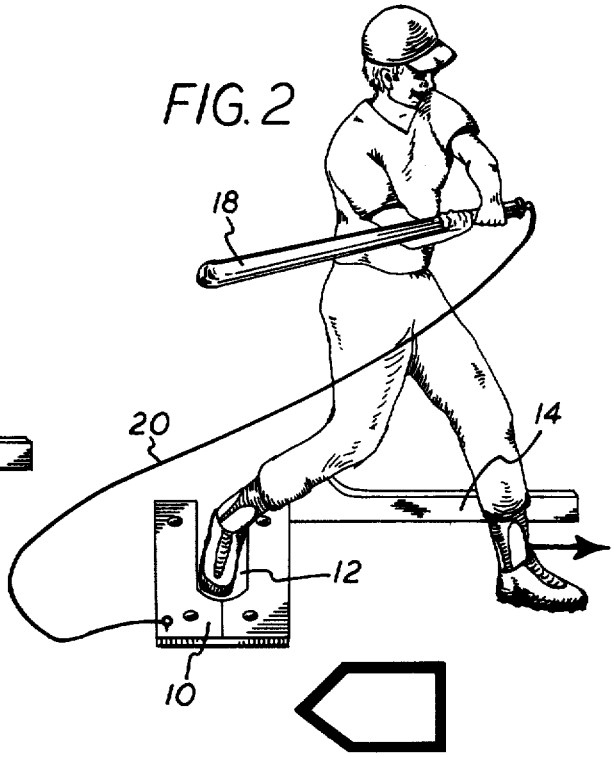
FIG. 2 illustrates a baseball batter taking a proper stride toward the pitcher's mound.

In accordance with the present invention, FIGS. 1 and 2 show the invention and illustrate its operation as the batter takes a proper stride toward the pitcher's mound. The device includes a base 10 that is generally rectangular but may also be of any other suitable shape. Base 10, which is preferably comprised of wood or plastic, includes a well 12 that is adapted to acomodate the rear foot of the batter. Base 10 is sufficiently thick that it will maintain the batter's back foot throughout the swing.

A guide arm 14 is flexibly connected to base 10 and longitudinally extends away from base 10. As shown more particularly in FIG. 4, arm 14 is preferably connected to base 10 by a hinge 16 such that arm 14 pivots between a first position (dashed lines) in which it is substantially normal to the major plane of base 10.

As shown in the Figures, the device is arranged in the batter's box such that base 10 is at the back of the batter's box and arm 14 is in the first position and extends substantially parallel to the direction of the pitcher's mound. Although the device shown has been designed for right-handed batters, it is apparent that when the device is of reverse construction, it is equally suitable for left-handed batters.

Figure 3:
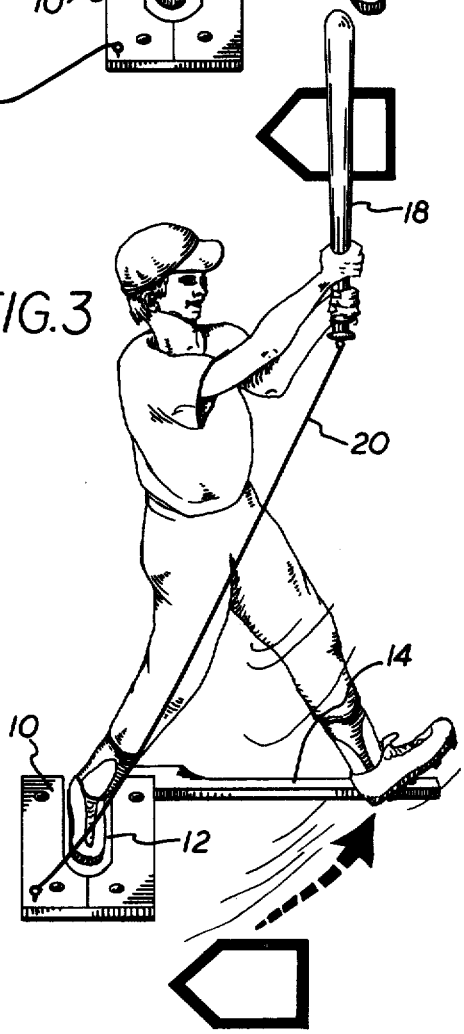
FIG. 3 illustrates a baseball batter taking an improper stride toward third base.
Figure 4:
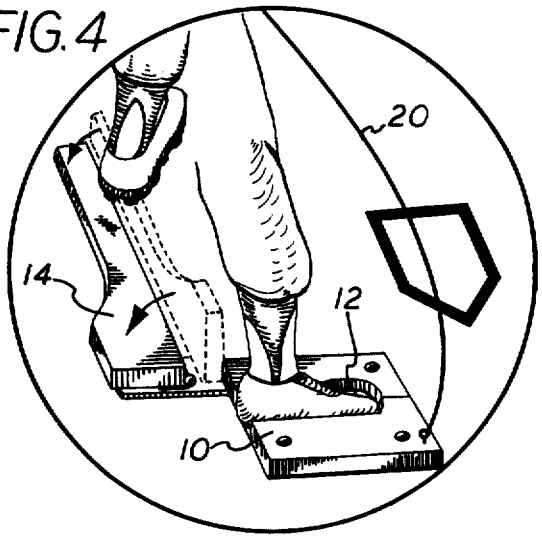
FIG. 4 is a partial view of FIG. 3 taken from behind the batter and showing the operation of the disclosed device.

As shown in FIG. 2, a batter striding toward the pitcher's mound steps free of arm 14. However, as shown in FIGS. 3 and 4, a batter that improperly steps toward the baseline will will kick arm 14. Arm 14 then acts as a yieldable barrier that advises the batter of the improper stride. By being repeatedly reminded whenever the stride is improper, the batter is thus taught to take a proper stride directly toward the pitcher's mound.

Since arm 14 pivots into a second position whenever kicked by the batter, it forms a yeildable barrier that reminds the batter of the improper stride, but does not trip the batter.

The device is further provided with a bat 18 that is connected to base 10 by a chord 20 connected to the handle end of bat 18. The length of chord 20 is adjusted in accordance with the height of the batter such that the chord 20 restrains the free swing of bat 18 at levels above the strike zone of the batter.

Chord 20 is particularly advantageous in that a problem attendant to striding away from the pitcher and into arm 14 is that there is a natural tendency to swing at pitches above the batter's strike zone. Chord 20 corrects this problem by checking the batter's swing when the bat is swung at levels above the strike zone.

As a further modification of the structure shown and described in connection with FIGS. 1-4, the invention can also include a ball that is connected to base 10 by a chord, thus providing a ball for the batter to swing at. When the ball is struck by bat 18, it is easily retrievable since its range of travel is limited by the chord connecting it to base 10.

While a presently perferred embodiment of the invention has been shown and described, it is to be understood that the invention is not limited thereto but can be otherwise variously embodied within the scope of the following claims.

I claim:

1. A device for teaching baseball batting techniques, said device comprising:

a base having a well therein for accomodating one foot of a batter; and a guide arm flexibly connected to the base such that it is pivoted between one position substantially normal to the base and a second position that is substantially parallel to the base, said guide being sufficiently high when in the one position to provide a yieldable barrier to the other foot of a batter striding into it.

2. The device of claim 1 wherein the guide arm is connected to the base by a hinge.

3. The device of claim 1 further comprising a baseball bat that is connected to the base by a cord, the length of the cord being adjustable in accordance with the height of the batter.

4. The device of claim 1 further comprising a cord, the length of the chord being adjustable in accordance with the height of the batter.

* * * * *